US005168986A

United States Patent [19]

Stenhouse

[11] Patent Number: 5,168,986

[45] Date of Patent: Dec. 8, 1992

[54] EARRING FRAME

[76] Inventor: Karen A. Stenhouse, Rode Hill House, Rode, Near Bath, Somerset BA3-6QH, United Kingdom

[21] Appl. No.: 845,638

[22] Filed: Mar. 4, 1992

[51] Int. Cl.[5] ..... A45C 11/16; A47F 7/00

[52] U.S. Cl. ..... 206/6.1; 206/45.14; 206/45.24; 206/566; 211/13

[58] Field of Search ..... 206/6.1, 566, 45.14, 206/45.24; 211/13

[56] References Cited

U.S. PATENT DOCUMENTS

| | | | |
|---|---|---|---|
| 1,528,229 | 3/1925 | Wetherell | 206/566 X |
| 3,421,634 | 1/1969 | Huth | 211/13 |
| 4,181,224 | 1/1980 | Aber | 206/566 |
| 4,687,103 | 8/1987 | Corbett | 206/566 |
| 4,735,246 | 4/1988 | Niehaus | 206/45.14 |
| 4,848,585 | 7/1989 | Snyder | 206/566 |
| 4,848,586 | 7/1989 | Jasik | 206/566 |
| 4,923,069 | 5/1990 | Germain et al. | 211/13 |
| 4,978,001 | 12/1990 | Nelson | 206/6.1 |
| 5,087,105 | 2/1992 | White | 211/13 X |
| 5,121,833 | 6/1992 | Lindsay et al. | 206/6.1 |

FOREIGN PATENT DOCUMENTS

| | | | |
|---|---|---|---|
| 1143073 | 2/1969 | United Kingdom | 206/566 |

*Primary Examiner*—William I. Price
*Attorney, Agent, or Firm*—Richard L. Miller

[57] ABSTRACT

An earring frame is provided which consists of a back panel having a front recessed area. A central panel is sized to fit into the front recessed area in the back panel. A plurality of support bars are for holding various types of earrings thereon. A mechanism is for attaching the support bars in parallel adjustable relationships onto the central panel. A front frame panel is of the same size as the back panel, while a plurality of fasteners are for removably securing the front frame panel onto the back pane. A mechanism is for supporting the earring frame in a stationary upright position for viewing.

7 Claims, 1 Drawing Sheet

EARRING FRAME

BACKGROUND OF THE INVENTION

The instant invention relates generally to jewelry display devices and more specifically it relates to an earring frame.

Numerous jewelry display devices have been provided in the prior art that are adapted to hold and display articles of jewelry in position, so that they can be seen thereon. For example, U.S. Pat. No. Des. 302,364 to Stewart; U.S. Pat. No. Des. 303,999 to Hansson and U.S. Pat. No. 4,905,821 to Corbett all are illustrative of such prior art. While these units may be suitable for the particular purpose to which they address, they would not be as suitable for the purpose of the present invention as hereafter described.

SUMMARY OF THE INVENTION

A primary object of the present invention is to provide an earring frame that will overcome the shortcomings of the prior art devices.

Another object is to provide an earring frame in which the method of storage is derived from the quick retrieval of any pair of earrings rather than to search through a mix of earrings as in other jewelry boxes or baskets.

An additional object is to provide an earring frame that is constructed in such a way that placing earrings in and out of the frame is a smooth and simple operation which requires less accuracy than that required to place the earring in specific holes in cards.

A further object is to provide an earring frame that is simple and easy to use.

A still further object is to provide an earring frame that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figures 1, 2, 3, 4, 5, 6, 7, 8, 9, 10, 11, 12:
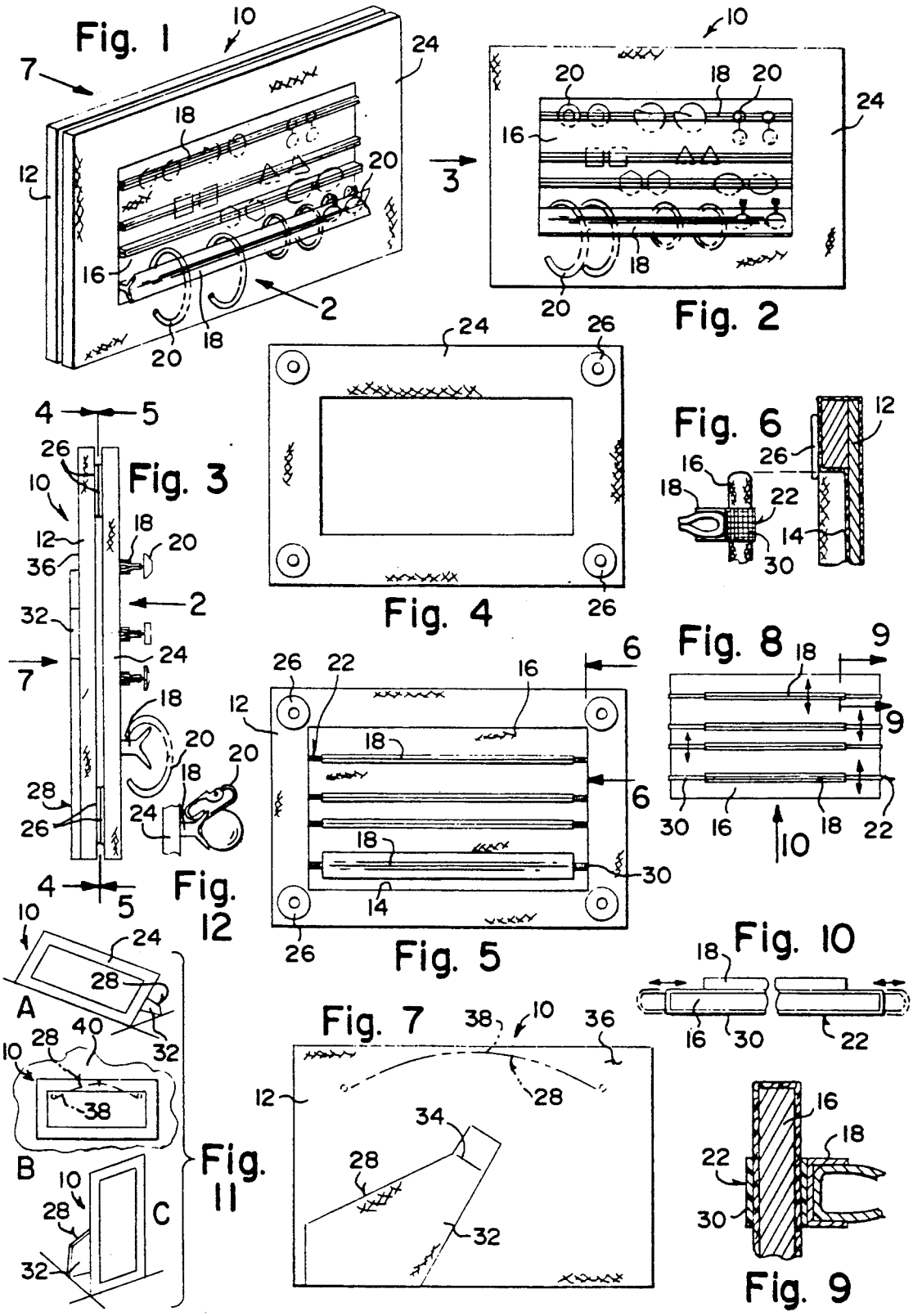
FIG. 1 is a diagrammatic front perspective view of the instant invention.
FIG. 2 is a diagrammatic front plan view taken in the direction of arrow 2 in FIG. 1.
FIG. 3 is a diagrammatic side view taken in the direction of arrow 3 in FIG. 2.
FIG. 4 is a view taken on line 4—4 on FIG. 3.
FIG. 5 is a view taken on line 5—5 of FIG. 3.
FIG. 6 is an enlarged cross sectional view taken on line 6—6 of FIG. 5 with parts broken away.
FIG. 7 is a diagrammatic rear plan view taken in the direction of arrow 7 in FIG. 1.
FIG. 8 is a reduced diagrammatic plan view of a component of the invention illustrating further structural features.
FIG. 9 is a diagrammatic cross sectional view with parts broken away taken on line 9—9 of FIG. 8.
FIG. 10 is a diagrammatic bottom edge view taken in the direction of arrow 10 in FIG. 8.
FIG. 11 is a diagrammatic composite illustrating the alternate display capabilities of the instant invention.
FIG. 12 is a diagrammatic side edge view of a portion of the instant invention showing a clip on earring attached to the lower support bar.

Turning now descriptively to the drawings, in which similar reference characters denote similar elements throughout the several views, the Figures illustrate an earring frame 10, which consists of a back panel 12 having a front recessed area 14. A central panel 16 is sized to fit into the front recessed area 14 in the back panel 12. A plurality of support bars 18 are for holding various types of earrings 20 thereon. A structure 22 is for attaching said support bars in parallel adjustable relationships onto the central panel 16. A front frame panel 24 is of the same overall size as the back panel 12, while a plurality of fasteners 26 are for removably securing the front frame panel 24 onto the back panel 12. A mechanism 28 is for supporting the earring frame 10 in a stationary upright position for viewing.

The back panel 12, the central panel 16, the support bars 18 and the front frame panel 24 may be typically fabric covered to give a soft and comfortable finish thereto. The attaching structure 22 includes a plurality of elastic bands 30, with each affixed to the ends of each of the support bars 18.

The supporting mechanism 28 can include a support stand 32 hinged at 34 onto the rear surface 36 of the back panel 12 at one corner thereof, so that the earring frame 10 can be free standing in a horizontal position as in FIG. 11A or in a vertical position as in FIG. 11C. The supporting mechanism 28 can also be a wire 38 secured onto the rear surface 36 of the back panel 12, so that the earring frame 10 can be hung on a flat vertical wall 40.

There are two different types of support bars 18. The first type of support bar 18, as best seen in FIG. 6 has a bifurcated configuration for holding the friction posts of pierced ear earrings 20 which are inserted there between (see FIGS. 1, 2 and 3). The second type of support bar 18 has a Y-shaped configuration, so that loop earrings 20, as shown in FIGS. 1, 2 and 3 and clip-on earrings 20, as shown in FIG. 12, can be easily attached thereto.

The elastic band 30 on each of the support bars 18 make the support bars 18 adjustable with respect to the central panel 16. The number of support bars 18 can also be varied to compensate for the amount of earrings 20 that are needed to be stored and displayed in the earring frame 10.

The fasteners 26 typically are of the snap-on type, so that the front frame panel 24 can be secured onto the back panel 12, to prevent the central panel 16 from being removed from the front recessed area 14 in the back panel 12.

The back panel 12, the central panel 16, the front frame panel 24, the support bars 18, and the support stand 32 can all be fabricated out of a durable strong material, such as plastic, wood, cardboard, metal and the like. The elastic bands 30 can be fabricated out of a stretchable material, such as rubber or an appropriate synthetic.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An earring frame which comprises:

a) a back panel having a front recessed area;

b) a central panel sized to fit into said front recessed area in said back panel;

c) a plurality of support bars for holding various types of earrings thereon;

d) means for attaching said support bars in parallel adjustable relationships onto said central panel;

e) a front frame panel being of the same size as said back panel;

f) a plurality of fasteners for removably securing said front frame panel onto said back panel; and g) means for supporting said earring frame in a stationary upright position for viewing.

2. An earring frame as recited in claim 1, wherein said back panel, said central panel, said support bars and said front frame panel are fabric covered to give a soft and comfortable finish thereto.

3. An earring frame as recited in claim 2, wherein said attaching means includes a plurality of elastic bands, each affixed to the ends of each of said support bars.

4. An earring frame as recited in claim 3, wherein said supporting means includes a support stand hinged onto the rear surface of said back panel at one corner thereof, so that said earring frame can be freestanding.

5. An earring frame as recited in claim 3, wherein said supporting means includes a wire secured onto the rear surface of said back panel, so that said earring frame can be hung on a flat vertical wall.

6. An earring frame as recited in claim 1, wherein said support bars for holding various types of earrings thereon has a bifurcated configuration for holding the friction posts of pierced ear earrings.

7. An earring frame as recited in claim 1, wherein said support bars for holding various types of earrings thereon has a Y-shaped configuration, so that loop earrings and clip-on earrings can be easily attached thereto.

* * * * *